US005697505A

United States Patent [19]

Sprague

[11] Patent Number: 5,697,505

[45] Date of Patent: Dec. 16, 1997

[54] MERCHANDISE DISPLAY STAND

[76] Inventor: Daryl S. Sprague, 840 Sparta Dr., P.O. Box 274, Lafayette, Colo. 80026

[21] Appl. No.: 470,917

[22] Filed: Jun. 6, 1995

[51] Int. Cl.[6] ..... A47F 7/00

[52] U.S. Cl. ..... 211/13; 211/59.4; 211/72; 248/174; D7/304

[58] Field of Search ..... 211/13, 59.4, 72, 211/74, 133, 186; 248/150, 152, 174; 312/257.1, 350, 265.4, 265.5; D7/304; 222/608, 609, 61; 62/3.64

[56] References Cited

U.S. PATENT DOCUMENTS

| | | | |
|---|---|---|---|
| 2,188,602 | 1/1940 | Hall | 248/174 |
| 2,914,184 | 11/1959 | Dgetluck | 211/72 X |
| 2,922,552 | 1/1960 | Berger et al. | 211/72 X |
| 3,088,289 | 5/1963 | Alex | 62/3.64 |
| 3,123,207 | 3/1964 | Goldstein | 211/72 X |
| 3,757,934 | 9/1973 | Taub | 248/174 X |
| 4,164,287 | 8/1979 | Muller et al. | 248/174 X |
| 4,205,818 | 6/1980 | Lawler | 248/174 X |
| 4,473,963 | 10/1984 | Hardy et al. | 248/174 X |
| 4,664,349 | 5/1987 | Johansen et al. | 248/150 |
| 4,753,341 | 6/1988 | McIntyre | 211/72 X |
| 4,760,928 | 8/1988 | Bustos | 248/174 X |
| 4,917,342 | 4/1990 | Fast | 248/174 |
| 5,494,195 | 2/1996 | Knuettel, II et al. | 62/3.64 X |

OTHER PUBLICATIONS

Star Metal Water Coolers Brochure, 1957.

*Primary Examiner*—Alvin C. Chin-Shue
*Assistant Examiner*—Anita M. King

[57] ABSTRACT

A merchandise display stand comprising a base member and a merchandise tray member for housing and displaying merchandise. The base member comprises a sidewall and a substantially hollow interior. The sidewall has an outer surface having at least one exhibit means visible from the outer surface for displaying printed matter such as an advertisement. The merchandise tray member is disposed at the top of the base member. The present invention includes a combination liquid dispensing apparatus and merchandise display stand. The liquid dispensing apparatus comprises a liquid dispenser unit having an exteriorly operable valve for releasing a liquid from a vessel situated on the top thereof. The merchandise display stand is constructed according to the above description whereby the hollow interior of the base member accommodates the vessel disposed on top of the liquid dispensing apparatus to thereby permit placing the stand over the vessel to form an integral unit.

13 Claims, 1 Drawing Sheet

MERCHANDISE DISPLAY STAND

BACKGROUND OF THE INVENTION

This invention relates in general to merchandise display devices, and in particular to a merchandise display stand comprising a base member having an exhibit means visible from the outer surface of the base member for displaying printed matter such as an advertisement for example, and a tray disposed on top of the base member for housing and displaying merchandise. The display stand can be situated over the water vessel of a cold water dispenser and in combination therewith can display candy and other snack items for sale to passers-by who can deposit money into a coin slot extending into a lockable compartment integral with the display stand.

The provision of merchandise such as snack foods, beverages, and the like in office buildings, retail establishments, etc. is a major industry. Chief among equipment capable of displaying and dispensing goods are vending machines that work electronically in response to the insertion of money in combination with a selection step. Another approach for selling items is the "honor box" method which usually comprises an open display of items for sale and a coin receptacle into which buyers place money for merchandise purchased. Purchasers are on their "honor" with respect to paying for, rather than stealing, the items they take. The honor box method for providing merchandise is highly effective in locations where placement of an expensive electronic vending machine is not practical. For example, personnel in a small office usually will purchase snack items on a regular basis, but are not of sufficient number per office to support placement of a large vending machine. In such instances the honor box approach can be utilized effectively.

The manner for displaying items for sale in current honor-box approaches usually involves employment of a shallow, open box in which such merchandise as candy, gum, etc. is situated. The shallow box generally resides directly on a counter top, and buyers select and pay for the items they want without much interest in the overall process. Because of the cumulative activity and traffic at honor-box locations, however, it is evident that interest could be developed on the part of the users. For example, if a display were to have means for presenting advertisements, notices of office or community events, special offers, etc., those visiting the honor box for snacks could additionally gain important information. Further, if an honor box site also has a liquid dispensing apparatus such as a conventional water cooler having a vessel from which water therein is dispensed, a display stand having a base member that could be situated to surround the vessel and thereby work in conjunction with the dispensing apparatus would not only save space, but also permit users to obtain snacks and water simultaneously.

In view of the above discussion, it is apparent that a unique honor box display stand could be beneficial. Accordingly, a primary object of the present invention is to provide a merchandise display stand having a base member that includes an exhibit means visible from the outer surface of the base member for displaying printed matter.

Another object of the present invention is to provide a merchandise display stand having a base member positionable around at least a portion of a vessel disposed on top of a liquid dispensing apparatus to thereby permit placing the stand over the vessel and in combination with the liquid dispensing apparatus.

These and other objects of the present invention will become apparent throughout the description of the invention which now follows.

SUMMARY OF THE INVENTION

The present invention is a merchandise display stand comprising a base member and a merchandise tray member for housing and displaying merchandise. The base member comprises a sidewall and a substantially hollow interior. The sidewall has an outer surface having at least one exhibit means visible from the outer surface for displaying printed matter such as an advertisement. The merchandise tray member is disposed at the top of the base member, and preferably comprises a floor surrounded by an upwardly projecting sidewall to thereby form a cavity wherein merchandise can be housed. Dividers can be disposed within the cavity to thereby conveniently arrange and retain merchandise there present in an organized manner.

The present invention includes a combination liquid dispensing apparatus and merchandise display stand. The liquid dispensing apparatus is conventionally known in the art and comprises a liquid dispenser unit having a top and an exteriorly operable valve means for releasing a liquid from the apparatus. A vessel is situated on the top of the dispenser unit and has an interior in which a liquid such as water can be housed. This interior is in communication with the valve means through which liquid is released from the vessel. The merchandise display stand is constructed according to the above description whereby the hollow interior of the base member accommodates the vessel disposed on top of the liquid dispensing apparatus to thereby permit placing the stand over the vessel to form an integral unit.

A primary utility for the present invention is that of providing a snack center for offices, retail establishments and the like. Thus, the tray member of the merchandise display stand can house candy, gum, powdered drink mixes, etc. available for purchase. Simultaneously, the base member of the display stand serves to convey information in the form of advertisements, notices and the like while also, when positioned over a liquid dispenser, achieving a food-and-drink unit with space-saving benefits. In this manner, the present invention fills a need for vending services while also creating a medium where advertisements and other printed matter can be favorably displayed to users of the service.

BRIEF DESCRIPTION OF THE DRAWINGS

An illustrative and presently preferred embodiment of the invention is shown in the accompanying drawings in which.

DETAILED DESCRIPTION OF A PREFERRED EMBODIMENT

Figure 1:
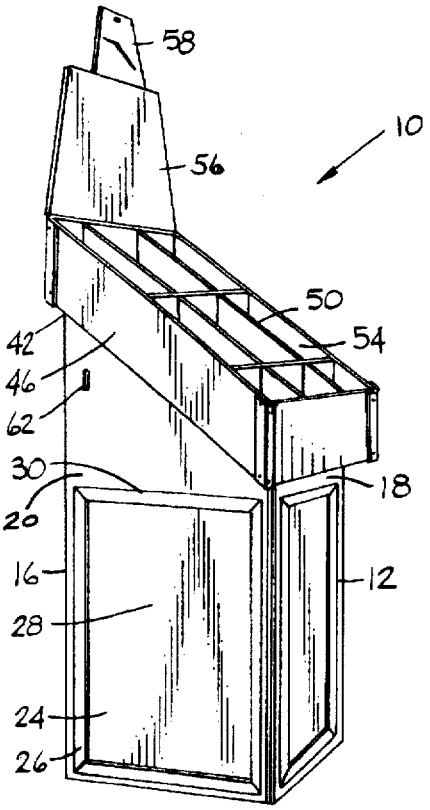
FIG. 1 is a front perspective view of a merchandise display stand according to the present invention.
Figure 2:
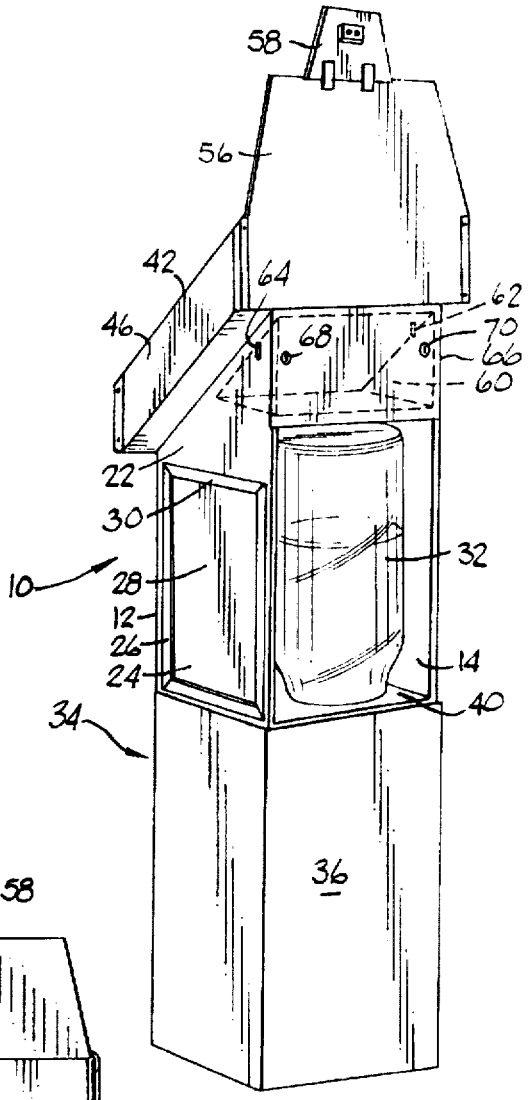
FIG. 2 is a rear perspective view of the merchandise display stand of FIG. 1 in combination with a liquid dispensing apparatus.
Figure 3:
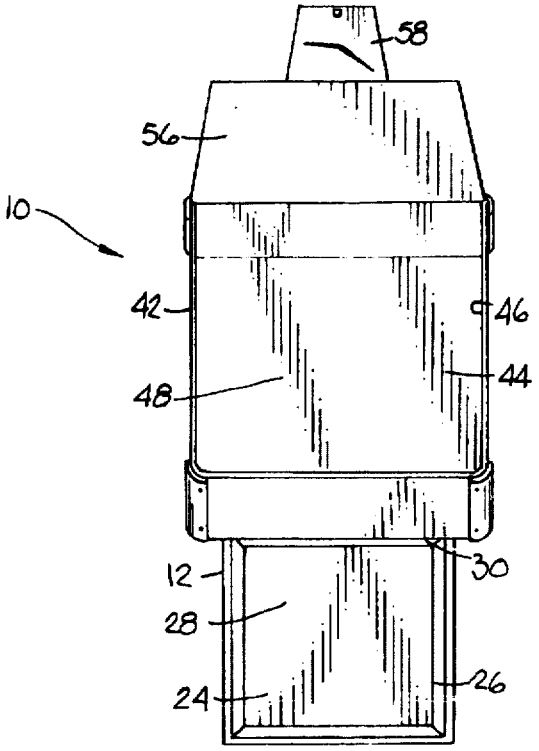
FIG. 3 is a front elevation view of the merchandise display stand of FIG. 1 except without the cavities shown in FIG. 1.

Referring to FIGS. 1–3, a merchandise display stand 10 is illustrated. The stand 10 comprises a base member 12 having a hollow interior 14 formed by a sidewall 16 consisting of a front panel 18 and two substantially parallel side panels 20, 22. Each of the side panels 18, 20, 22 is provided with a respective identical exhibit housing 24 having a perimeter defined by a frame 26 and an outer wall which is a transparent sheet 28 behind which printed matter such as an advertising sheet can be placed. Access to the interior of the housing 24 in order to change printed matter therein is accomplished by removing the removable top member 30 of the frame 26. The hollow interior 14 of the base member 12 is sized to accommodate a vessel 32 (FIG. 2) of a liquid dispensing apparatus such as a conventional water cooler 34 known in the art and depicted in FIG. 2. Such a water cooler 34 includes an exteriorly operable valve means 38 (FIG. 4) in the dispenser unit 36 and in communication with the vessel 32 for releasing the water (or another liquid) stored in the vessel 32. In the present invention, the base member 12 of the merchandise display stand 10 rests on the top 40 of the dispenser unit 36. The exteriorly operable valve means 38 is situated at the front of the dispenser unit 36.

A merchandise tray member 42 for housing and displaying merchandise such as candy, gum, etc. has a floor 44 and an upwardly projecting sidewall 46 to thereby form a cavity 48 in which merchandise can be retained. Depending on the type and size of merchandise held by the tray member 42, one or more dividers 50 can be disposed in the cavity 48 to thereby organize and separate merchandise in an orderly manner. Preferably, the dividers 50 can be part of an insert 54 as shown in FIG. 1 that is sized to fit within the cavity 48. When such is the case, a pre-loaded insert can be quickly placed within the cavity 48 after a less than full insert is removed for later restocking. Projecting upwardly from the rear of the tray member 42 is a back board 56 having attached at the top thereof a battery operated clock 58 as known in the art. Beneath the tray member 42 in the base member 12 is a coin receptacle 60 (shown in phantom lines in FIG. 2) having coin slots 62, 64 into which a customer can insert coins to pay for merchandise taken from the tray member 42. A hinged door 66 having two key locks 68, 70 opens downwardly for access to the money deposited.

Figure 4:
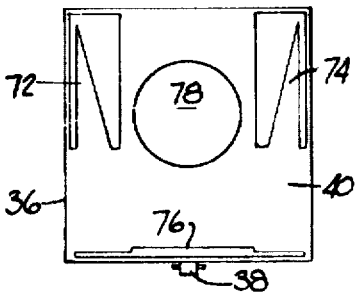
FIG. 4 is a top plan view of a dispenser unit of a water cooler.

Although not required, but to accommodate ease of moving, the stand 10 preferably is constructed of a relatively lightweight yet durable material. In the preferred embodiment, Sintra® rigid closed-cell homogenous foamed board, available from Alucobond Technologies, Inc., Benton, Ky. is employed as the primary construction material for the stand 10. All flat surfaces are made of Sintra material and are joined to each other with L-shaped connectors held in place with screws, glue, etc., as known in the art. Of course, other materials, including, but not limited to, plastic, fiberglass, metal, wood, etc., as would be recognized by the skilled artisan, can be employed to accomplish construction of the stand 10. In typical use, the stand 10 is placed over the vessel 32 of a conventional water cooler 34 as found in an office or other commercial setting. The tray member 42 is filled with a selection of various snack items such as gum, candy bars, packages of chips, crackers, etc. which are subsequently purchased by passers-by who pay for the items bought by depositing coins through the coin slots 62, 64. While purchasing items and/or obtaining water from the water cooler 34 and/or simply passing by, individuals are drawn to advertising or other printed matter displayed in the exhibit housings 24 disposed on the base member 12, thereby encouraging advertisers or the like to display communications. When the vessel 32 becomes empty and is to be replaced by a full vessel 32, an attendant simply slides the stand 10 from the cooler 34, changes the vessel 32, and then replaces the stand 10 to its original position. Respective friction-fit guide tracks 72, 74, as shown in FIG. 4, constructed of flat sheet can be appropriately adhered on the top 40 of the dispenser unit 36 to accommodate the bottom edges of the parallel panels 18, 20 to aid in guiding and securing the stand 10 on the dispenser unit 36. Additionally, a front retainer dam 76 also constructed of flat sheet can be adhered on the top 40 such that the front panel 18 of the base member 12 is retained behind the dam 76. As is recognizable, the opening 78 shown in the dispenser unit 36 accepts the neck (not shown) of a typical vessel 32 through which water flows into the dispensing unit 36 for release there from.

As is evident, the stand 10 can fill a need for a convenient source of food items or other merchandise in a commercial setting while simultaneously providing an excellent medium for the publicization of advertising material, important announcements, or any other printed matter accommodated in the exhibit housings 24 and viewable from the exterior.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

I claim:

1. A merchandise display stand comprising:

a) a base member comprising a sidewall and a substantially hollow interior, said sidewall having an outer surface having at least one exhibit means visible from the outer surface of the sidewall for displaying printed matter;

b) a merchandise tray member for housing and displaying merchandise; and c) a lockable compartment into which a coin slot extends from the outside.

2. A merchandise display stand as claimed in claim 1 wherein the sidewall is three connected panels, with two of said panels substantially parallel with each other, and further wherein the hollow interior of the base member is sized to accommodate a vessel disposed on top of a liquid dispensing apparatus to thereby permit placing the stand over the vessel.

3. A merchandise display stand as claimed in claim 2 wherein the exhibit means comprises a housing having a perimeter defined by a frame and an outer wall defined by a transparent sheet behind which printed matter can be inserted.

4. A merchandise display stand as claimed in claim 1 wherein the exhibit means comprises a housing having a perimeter defined by a frame and an outer wall defined by a transparent sheet behind which printed matter can be inserted.

5. A merchandise display stand as claimed in claim 4 wherein the tray member comprises a floor surrounded by an upwardly projecting sidewall to thereby form a cavity wherein merchandise can be housed.

6. A merchandise display stand as claimed in claim 1 wherein the tray member comprises a floor surrounded by an upwardly projecting sidewall to thereby form a cavity wherein merchandise can be housed.

7. A combination liquid dispensing apparatus and merchandise display stand comprising:

a) a liquid dispensing apparatus comprising a dispenser unit having a top and an exteriorly operable valve means for releasing a liquid from the apparatus, and a vessel situated on the top of the dispenser unit and having an interior in which a liquid can be housed, with said interior being in communication with the valve means and from which liquid is released; and b) a merchandise display stand comprising a base member comprising a substantially hollow interior within which is disposed the vessel and a sidewall surrounding at least a portion of the hollow interior, said sidewall having a portion thereof in contact with the top of the dispenser unit and further having an outer surface having at least one exhibit means visible from the outer surface of the sidewall for displaying printed matter, and a merchandise tray member for housing and displaying merchandise.

8. A combination liquid dispensing apparatus and merchandise display stand as claimed in claim 7 wherein the sidewall is three connected panels, with two of said panels substantially parallel with each other.

9. A combination liquid dispensing apparatus and merchandise display stand as claimed in claim 7 and having in addition a lockable compartment into which a coin slot extends from the outside.

10. A combination liquid dispensing apparatus and merchandise display stand as claimed in claim 7 wherein the exhibit means comprises a housing having a perimeter defined by a frame and an outer wall defined by a transparent sheet behind which printed matter can be inserted.

11. A combination liquid dispensing apparatus and merchandise display stand as claimed in claim 7 wherein the tray member comprises a floor surrounded by an upwardly projecting sidewall to thereby form a cavity wherein merchandise can be housed.

12. A combination liquid dispensing apparatus and merchandise display stand as claimed in claim 7 wherein the top of the dispenser unit has guide means for guiding placement of the portion of the base member of the merchandise display stand in contact with the top of the dispenser unit.

13. A merchandise display stand comprising:

a) a base member comprising a substantially hollow interior than can accommodate a vessel disposed on top of a liquid dispensing apparatus and a sidewall surrounding at least a portion of the hollow interior, said sidewall being three connected panels with two of said panels substantially parallel with each other, and an outer surface having at least one exhibit means comprising a housing having a perimeter defined by a frame and an outer wall defined by a transparent sheet behind which printed matter can be inserted and be visible from the outer surface of the sidewall; and b) a merchandise tray member for housing and displaying merchandise, said tray member comprising a floor surrounded by an upwardly projecting sidewall to thereby form a cavity wherein merchandise can be housed.

* * * * *